US005711766A

United States Patent [19]

Bain

[11] Patent Number: 5,711,766

[45] Date of Patent: Jan. 27, 1998

[54] WOOD FIRE STARTER HAVING IMPROVED STACKING PROPERTIES

[75] Inventor: Bruce K. Bain, Akron, Ohio

[73] Assignee: Forest Technology Corporation, Akron, Ohio

[21] Appl. No.: 605,520

[22] Filed: Feb. 26, 1996

[51] Int. Cl.[6] ..... C10L 5/36

[52] U.S. Cl. ..... 44/530; 44/532; 44/572; 44/576

[58] Field of Search ..... 44/530, 532, 573, 44/576

[56] References Cited

U.S. PATENT DOCUMENTS

| | | | |
|---|---|---|---|
| 2,117,415 | 5/1938 | Goss et al. | 44/10 |
| 3,637,355 | 1/1972 | Brockbank | 44/1 R |
| 3,726,651 | 4/1973 | Ronden | 44/14 |
| 3,843,336 | 10/1974 | Messman | 44/25 |
| 3,973,922 | 8/1976 | Williams | 44/13 |
| 4,046,518 | 9/1977 | Dalzell | 44/10 |
| 4,220,453 | 9/1980 | Holder | 44/10 |
| 4,230,459 | 10/1980 | Moreau et al. | 44/10 |
| 4,293,313 | 10/1981 | Fox | 44/1 |
| 4,308,032 | 12/1981 | Benson | 44/1 |
| 4,333,738 | 6/1982 | Schrader | 44/15 |
| 4,386,937 | 6/1983 | Fereri et al. | 44/41 |
| 4,518,394 | 5/1985 | Templin et al. | 44/38 |
| 4,522,585 | 6/1985 | Martin | 431/344 |
| 4,627,854 | 12/1986 | Pratt | 44/40 |
| 4,627,951 | 12/1986 | Shen | 264/109 |
| 4,651,049 | 3/1987 | Smith, Jr. | 44/10 |
| 4,725,286 | 2/1988 | Brame | 44/38 |
| 4,773,387 | 9/1988 | Zulkowitz | 126/152 |
| 4,818,249 | 4/1989 | Barrett, Jr. | 44/14 |
| 4,877,417 | 10/1989 | Crace | 44/535 |
| 4,878,922 | 11/1989 | Kaye | 44/502 |
| 4,952,216 | 8/1990 | Good | 44/25 |
| 4,994,091 | 2/1991 | Dougherty et al. | 44/532 |
| 5,026,579 | 6/1991 | Thow | 428/15 |
| 5,067,476 | 11/1991 | Rhodes, Jr. | 126/540 |
| 5,112,365 | 5/1992 | MacIsaac et al. | 44/576 |
| 5,118,539 | 6/1992 | Sebby et al. | 428/15 |
| 5,284,686 | 2/1994 | Thow | 428/15 |
| 5,360,586 | 11/1994 | Wyatt et al. | 264/54 |
| 5,393,310 | 2/1995 | Wollen | 44/536 |

*Primary Examiner*—Christopher Raimund
*Attorney, Agent, or Firm*—Vickers, Daniels & Young

[57] ABSTRACT

A wax-based brick such as a wax and sawdust brick for starting fires in fireplaces and the like is shaped to reduce the area of contact between adjacent bricks in a stack to make the bricks easy to separate from the stack even when the wax has slightly melted. The bricks may have a central cross-section which is octagonal, hexagonal, trapezoidal, or generally rectangular with convex or concave upper and lower walls. The end portions of the bricks have generally rectangular cross-sections to facilitate stacking.

29 Claims, 4 Drawing Sheets

WOOD FIRE STARTER HAVING IMPROVED STACKING PROPERTIES

The present invention is directed toward a wood fire starter and more specifically toward a wax-based wood fire starter brick having improved characteristics.

BACKGROUND OF THE INVENTION

Fireplace fires can be difficult to start. Unless one is skillful and has access to well-seasoned wood, dry kindling, wadded newspaper and a chimney with a good draft, much time and effort will be wasted trying to get a fire started. All too often, at least one of these requirements is lacking. These problems led to the development of wood fire starters such as STARTERLOGG brand fire starters which are manufactured by the assignee of the present invention. Wood fire starters are made primarily from a mixture of wax and sawdust and can be lighted easily with a match and can burn for 15 to 45 minutes, depending on the size and quality of the product. These products burn evenly and intensely, are sized to rest on a fireplace grate, and make it possible to light a fireplace fire without newspaper or kindling or when the wood is slightly damp. They allow almost anyone to start a fire successfully.

Wood fire starters are generally brick-shaped, but almost any shape can be used. These products are often sold stacked one atop another in multiple-unit packages. A problem which often arises when the product is packaged in this manner is that the individual fire starters, being made largely of wax, tend to stick together. Because the products are rectangular, and the side and end walls of the product are evenly aligned, they can be very difficult to separate when partially stuck together. This problem is aggravated when the fire starters are stored in close proximity to a heat source such as a fireplace or wood stove or when unused fire starters are stored over the summer in hot weather. Even moderate temperatures can cause some degree of sticking.

These melted-together fire starters can be separated and used, but only with some difficulty. Sometimes, they can be broken by hand, but often a knife or screwdriver must be inserted between the bricks to separate them. Besides being inconvenient, attempts to separate the bricks may end up breaking the bricks themselves into pieces too small to sit on a fireplace grate. Separating the bricks in this manner can also create many small flakes or crumbs of wax and sawdust which are a further nuisance.

This problem can be overcome by individually wrapping each brick or by inserting papers between the bricks, but this solution increases the cost of the product and slows production. Alternatively, bricks can be chemically treated to render them less sticky or they can be dusted with talc or other substances to reduce sticking, but these actions increase cost and adversely affect the lighting and burning characteristics of the product. It is therefore desirable to provide an improved wood fire starter which can be made and packaged in a standard manner, but which is also easy to separate from the other fire starters in the package.

SUMMARY OF THE INVENTION

These and other problems are overcome by the present invention which comprises a wood fire starter shaped so as to reduce the contact area between adjacent, stacked fire starters. A first embodiment of the invention comprises a brick having a generally octagonal cross-section. This cross-section allows the fire starters to be stacked such that the area of the contact region between the bricks is less than the width of the brick. Generally, bricks having a cross-section with five or more sides comprise part of the present invention. However, the octagonal cross-section is preferred over these other shapes as it allows the fire starter to maintain a generally brick-shaped appearance and does not adversely affect the extrusion process by which these products are normally manufactured. Stacked octagonal bricks can also efficiently fill a substantial volume of a standard rectangular package. The bricks may also be provided with generally rectangular end portions to increase the stability of the bricks when stacked. The use of a flattened end portion in this manner creates a generally I-shaped region of contact between the bricks which provides stability while still allowing the bricks to be easily separated. A second embodiment of the invention comprises a generally rectangular brick having convex top and bottom walls. When stacked, these convex walls contact one another only along a narrow strip and thus are easy to separate even when slightly melted together. A third preferred embodiment uses a brick having concave upper and lower walls which contact one another only along the outer edges thereof when stacked. A fourth preferred embodiment of the invention comprises bricks having a trapezoidal cross-section with one of the parallel walls being shorter than the other, wherein the parallel walls form the top and bottom walls of the bricks when stacked. A fifth embodiment of the subject invention comprises bricks having a hexagonal cross-section.

It is therefore the principal object of the present invention to provide a wax-based brick which can be stacked and easily separated from a stack.

It is another object of the present invention to provide a wax-based brick shaped to provide gaps between the brick and adjacent bricks when stacked.

It is a further object of the present invention to provide a wax-based brick which can be stacked and cleanly separated from a stack.

It is still another object of the present invention to provide a compact package of wax-based fire starters which can be easily separated from one another.

It is still a further object of the present invention to provide a wax-based fire starter brick which can be stacked with less contact between bricks than occurs when rectangular bricks are stacked.

It is yet another object of the present invention to provide a generally rectangular package of non-rectangular wax-based fire starters.

It is yet another object of the present invention to provide a wax-based fire starter brick which can be stacked to substantially fill a rectangular volume while minimizing the are of contact between the bricks.

It is a further object of the present invention to provide a stable stack of wax based bricks having a reduced region of contact between the bricks and recesses between adjacent bricks allowing one to easily grasp and then separate adjacent bricks.

BRIEF DESCRIPTION OF THE DRAWINGS

These and other objects of the present invention will be better appreciated from a reading and understanding of the detailed description of the invention together with the following drawings of which.

DETAILED DESCRIPTION OF THE PREFERRED EMBODIMENTS

Figure 1:
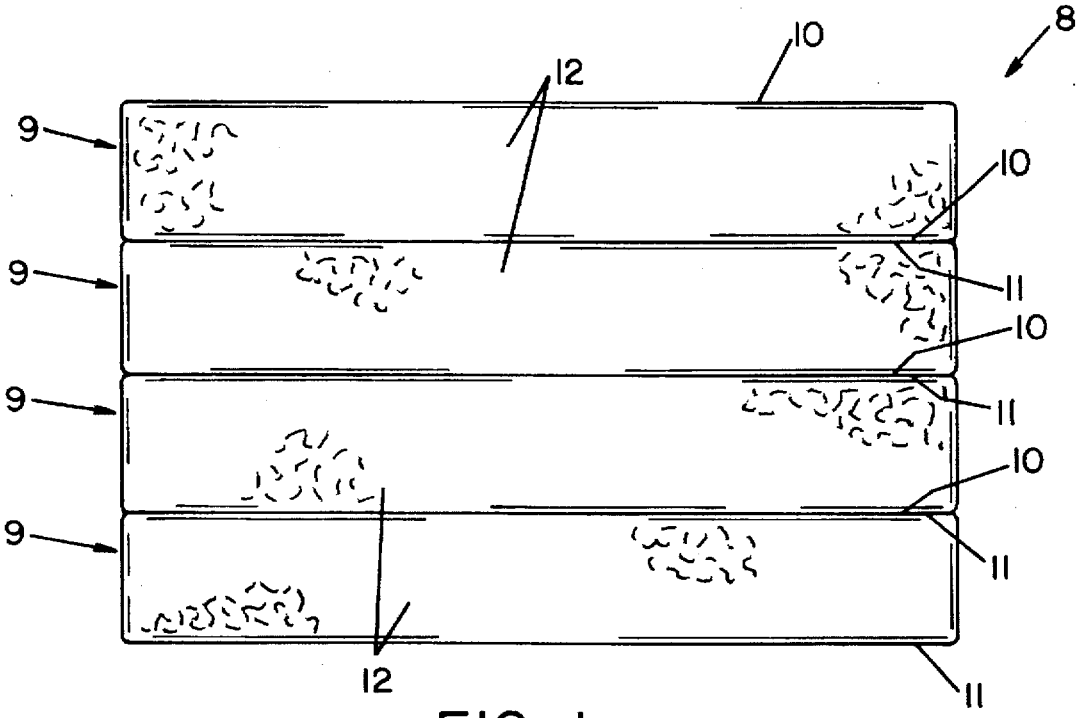
FIG. 1 (PRIOR ART)
FIG. 1 is a side elevational view of a prior art stack of firestarter bricks.

Referring now to the drawings, where the showings are for purposes of illustrating preferred embodiments of the subject invention only, and not for limiting same, FIG. 1 shows a stack 8 of prior art fire starter bricks 9. These prior art bricks are rectangular solids and have parallel and planar top walls 10 and bottom walls 11 extending between parallel and planar side walls 12. When stacked as shown in FIG. 1, there is no space between the bricks 9 and the bricks tend to stick to one another when stored. Such bricks are all of the same size and are stacked squarely atop one another which makes them difficult to separate without the use of a knife or without breaking the bricks into unusably small fragments.

Figure 2:
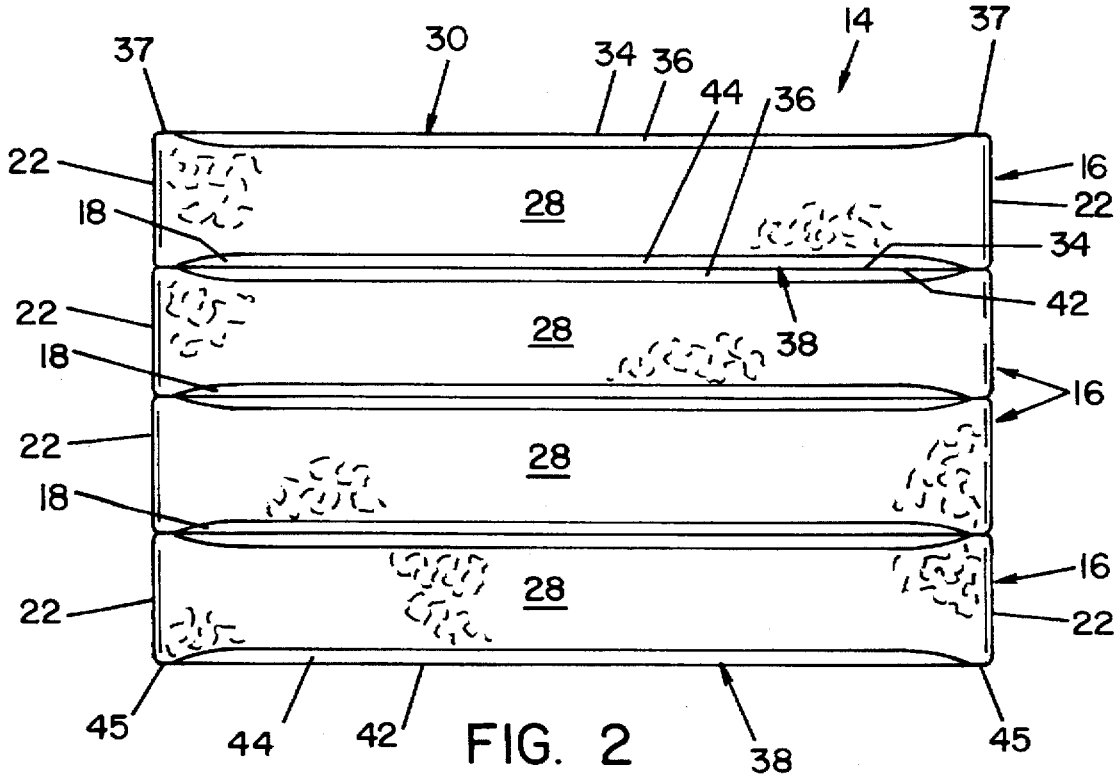
FIG. 2 is a side elevational view of a stack of firestarter bricks according to the present invention.
Figure 3:
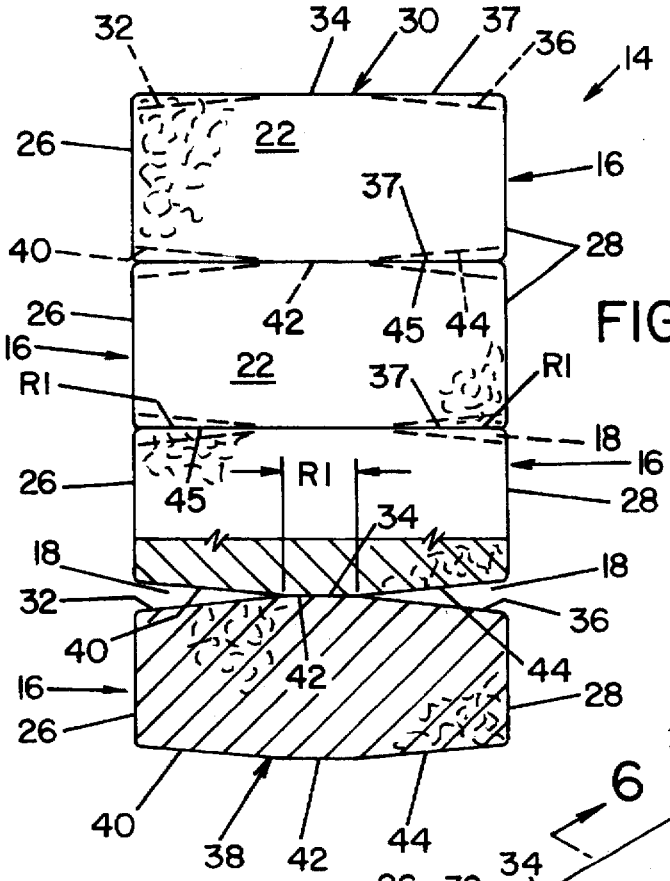
FIG. 3 is a front elevational view, partly in section, of the stack of bricks shown in FIG. 2.
Figure 4:
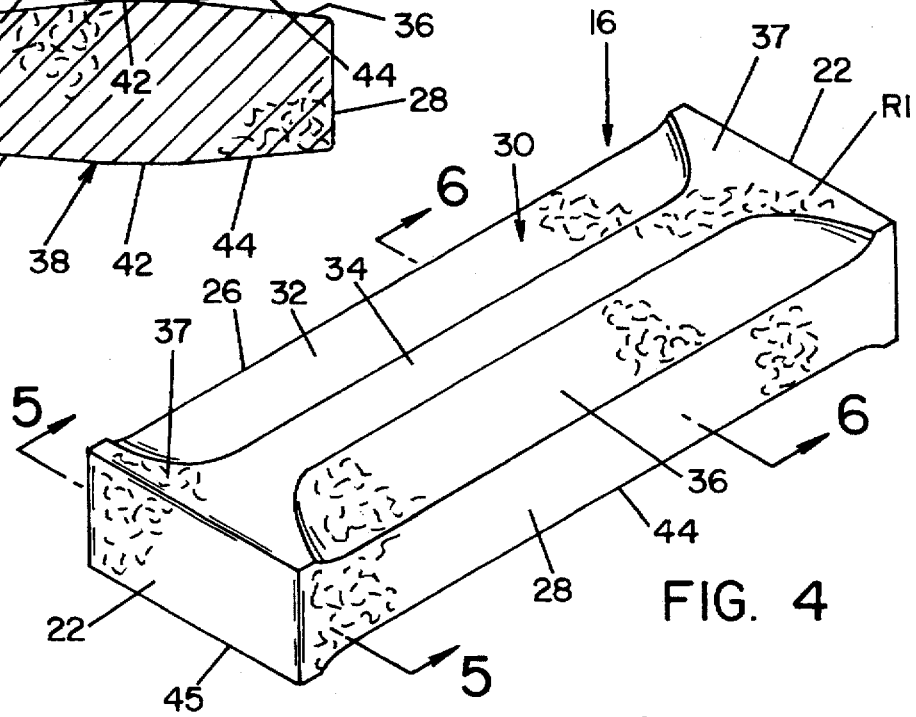
FIG. 4 is a perspective view of an individual brick taken from the stack shown in FIGS. 2 and 3.
Figure 11:
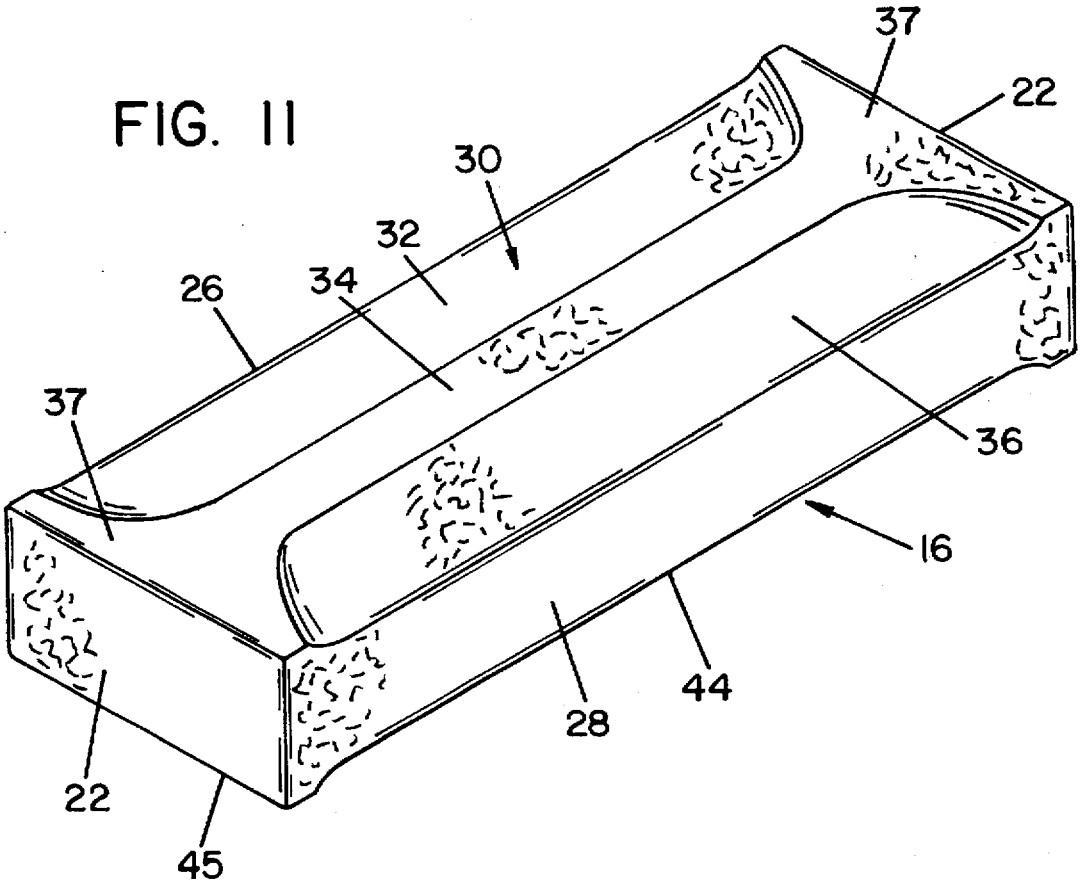

FIGS. 2 and 3 show a stack 14 of fire starter bricks 16 according to a first embodiment of the present invention and FIGS. 4 and 11 show one of these bricks separated from the stack. Each brick preferably has a length of about 7 inches, a width of about 2½ inches and a height of about 1 inch. As can be seen from these figures, the bricks 16 are generally octagonal which results in the creation of gaps 18 between the bricks when stacked. As best seen in FIG. 4, the bricks 16 each include front and rear end walls 22, a left side wall 26 and a right side wall 28, and a top wall 30 comprising a first sloped portion 32, a central portion 34, a second sloped portion 36 and flattened end portions 37 extending about ¼ inch inwardly of each of the end walls 22. The bottom wall 38 of the brick 16 is identical to the top wall 30 and includes a first sloped portion 40, a central portion 42, a second sloped portion 44 and flattened end portions 45 adjacent each of the end walls 22. The top wall central portions 34 are about ½ inch wide (or about ¼ of the overall brick width) and are generally horizontal when the bricks are stacked and are parallel to the bottom wall central portions 42. The side walls 26 and 28 are about ⅞ inch high and are generally vertical and parallel to one another. The top wall sloped portions 32 and 36 are about ⅞ inch wide slope away from the top wall central portion 34 in the direction of the bottom wall 38 at an angle of about 2 to 10 degrees from the horizontal. A slope of about 4 degrees is preferred. The bottom wall sloped portions 40 and 44 slope away from the bottom wall central portion 42 toward the top wall at a similar angle.

To form a stack 14 from the bricks 16, a first brick 16 is placed with the bottom wall central portion 42 on a horizontal surface and a second brick 16 is placed such that the bottom wall central portion 42 thereof rests on the top wall central portion 34 of the first brick and so that the flattened end portions 45 of the bottom wall rest on the flattened end portions 37 of the top wall. The region of contact R1 between the bricks in this embodiment is therefore generally I-shaped and defined by the flattened end portions 37 and central top wall portions 34 of the lower brick and the flattened end wall portions 45 and bottom wall central portion 42 of the upper brick. Significantly this region of contact is approximately 4½ square inches instead of the 17½ square inch, rectangular, region of contact which results when prior art bricks are stacked. And because the contact occurs only near the ends of the bricks and along a narrow central strip between the end portions, it is easy to obtain leverage along the sides of the bricks to break adjacent bricks apart. Stacking the bricks in this manner also produces the gaps or channels 18 therebetween which makes the bricks easier to separate, even when they have slightly melted. The gaps or channels 18 are about ⅛ inch wide and extend along the sides of the bricks between the flattened end portions 37. The channels are also preferably about ⅞ inch deep and defined by the second sloped top wall portion 36 of a lower brick and the second sloped bottom wall portion 44 of an upper brick. These gaps reduce sticking as described above and provide an opening into which a user's finger tips can be placed to obtain leverage to pry the bricks apart. The octagonal shape makes the bricks 16 easy to separate from the stack but does not affect their manufacturing cost or burning characteristics.

Figure 5:
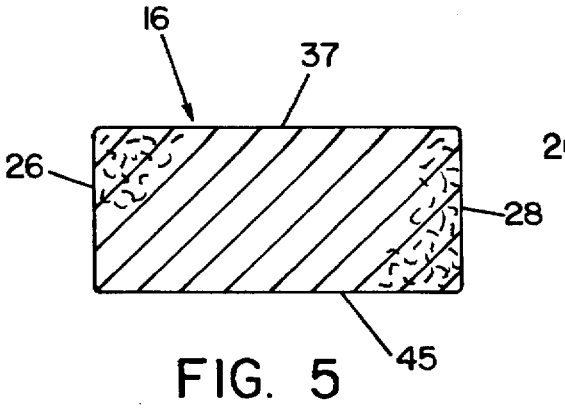
FIG. 5 is a cross-sectional view taken through line 5—5 in FIG. 4.
Figure 6:
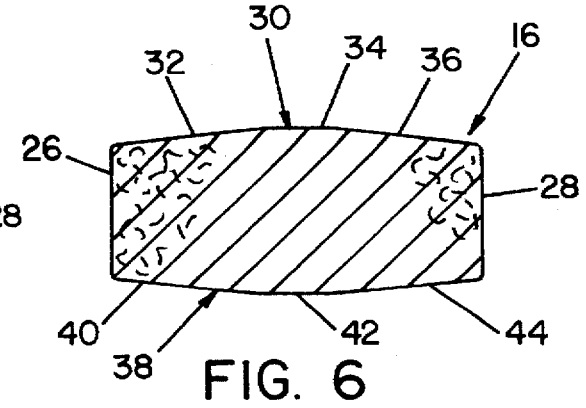
FIG. 6 is a cross-sectional view taken through line 6—6 in FIG. 4.

The bricks 16 are formed by an extrusion process and are cut to length as they pass through a die (not shown). The brick ends are formed into flattened end portions 37 and 45 in the cutting process. Thus, the bricks 16 have a rectangular cross-section through the flattened end portions 37 and 45 as shown in FIG. 5 and an octagonal cross-section between these portions as shown in FIG. 6. These rectangular end portions provide greater stability to the stack 14 and also provide a solid appearance to the stack 14 when viewed end-on.

Figure 7:
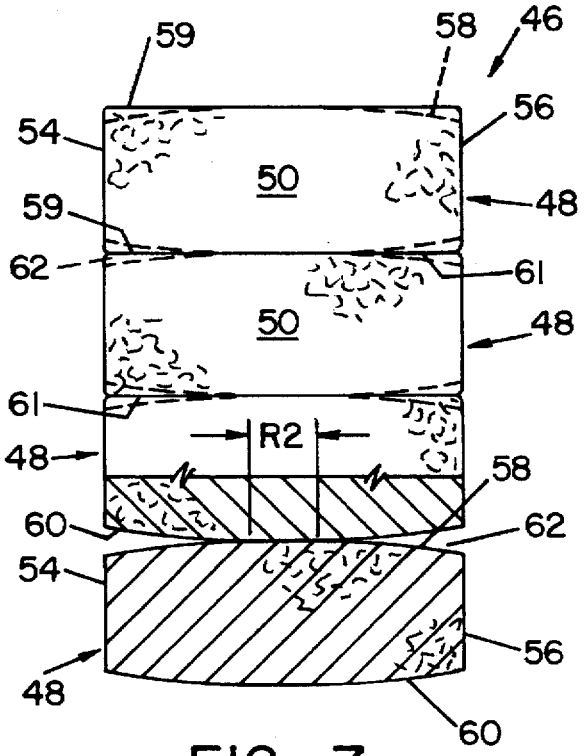
FIG. 7 is an end elevational view, partially in section, of a stack of firestarter bricks according to a second embodiment of the subject invention.

FIG. 7 shows a stack 46 of bricks 48 according to a second embodiment of the present invention. The bricks 48 each have front and rear end walls 50, a left side wall 54, a right side wall 56, a convex top wall 58 having flattened end portions 59 and a convex bottom wall 60 having flattened end portions 61. Walls 58 and 60 are smoothly radiused and bow away from one another between the side walls 54 and 56. When these bricks 48 are stacked, the bottom wall 60 of an upper brick 48 rests atop the top wall 58 of a lower brick 48 and the flattened end portions 61 of the bottom wall of the top brick rest on the flattened end portions 59 of the top wall of the lower brick. The resulting region of contact R2 between the bricks is generally I-shaped and defined by the flattened end portions of the bricks and the central portions of the top and bottom walls. In addition, the radiused top and bottom walls produce a gap 62 between the side walls of adjacent bricks when stacked. This gap is preferably about ⅛ inch wide or more and a user's finger tips can be inserted therein to overcome any minimal stickiness between the bricks.

Figure 8:
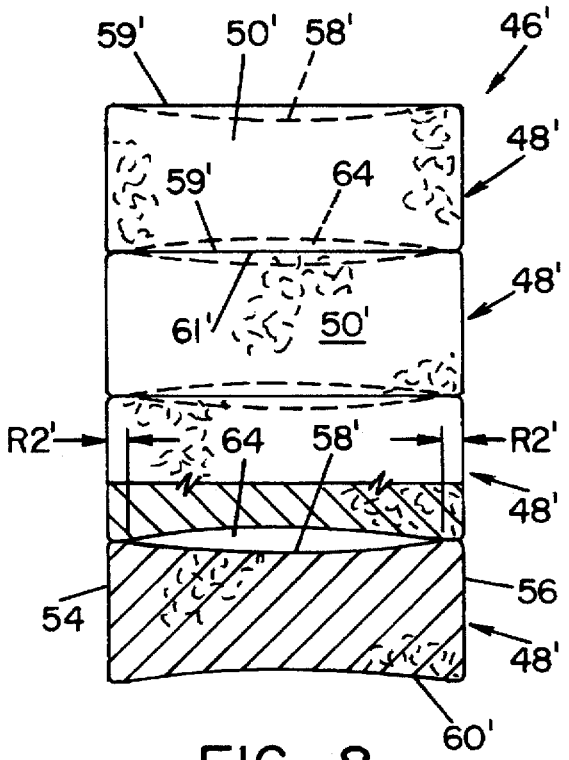
FIG. 8 is an end elevational view, partly in section, of a stack of firestarter bricks according to a third embodiment of the subject invention.

FIG. 8 shows a third preferred embodiment of the subject invention which comprises a stack 46' of bricks 48' similar to the bricks 48 of the second embodiment, but which include a concave top wall 58' and concave bottom wall 60' instead of the convex walls of the second preferred embodiment. Bricks 48 also include top wall flattened end portions 59' and bottom wall flattened end portions 61' in the vicinity of end walls 50'. When bricks 48' are stacked, the region of contact R2' between the bricks is comprised of the region near the left side wall 54 and the right side wall 56 and the flattened end portions 59' and 61'. This leaves a central gap 64 about ⅛ inch wide between the bricks. The presence of gaps 64 greatly reduces the amount of sticking which occurs when the bricks are stacked. This embodiment results in a stack of bricks which appears identical to the prior art stacks of bricks as shown in FIG. 1, but by reducing the region of contact between the top and bottom walls of the bricks, the sticking problem is greatly reduced.

Figure 9:
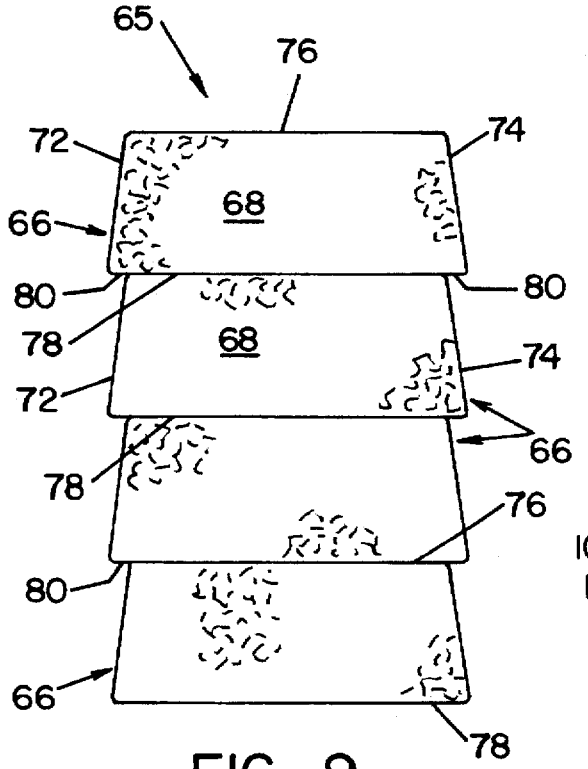
FIG. 9 is an end elevational view of a stack of firestarter bricks according to a fourth embodiment of the subject invention.

FIG. 9 shows a stack 65 of bricks 66 according to a fourth embodiment of the subject invention which bricks 66 have trapezoidal front and rear end walls 68, a left side wall 72, a right side wall 74, a top wall 76 and a bottom wall 78. Importantly, the top wall 76 is narrower than the bottom wall 78, and the side walls converge toward one another in the direction from the bottom wall 78 to the top wall 76. This gives the brick 66 a trapezoidal cross-section taken parallel to the end walls. In this embodiment, the entire area of the top wall 76 of a first brick 66 contacts the bottom wall 78 of a second brick 66 when the bricks 66 are stacked. However, because the bottom wall 78 is wider than the top wall 76 that supports it, a portion 80 of bottom wall 78 overhangs the top wall 76 on each side thereof. This overhang provides a convenient gripping point and allows a brick 66 to be pried off of a brick beneath it in a stack. This configuration allows fire starter bricks to be easily separated while maintaining wider planar upper and lower walls, which could be desirable in some instances and provides stability.

Figure 10:
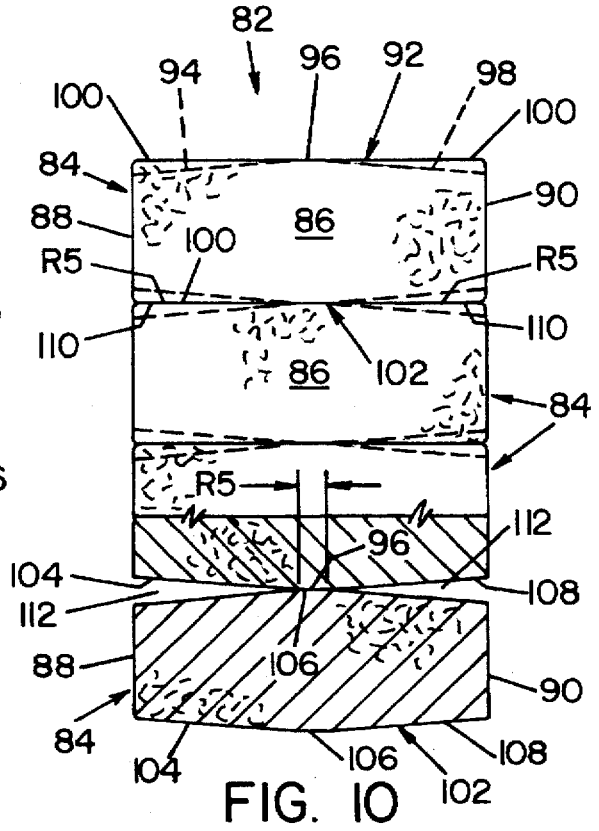
FIG. 10 is an end elevational view, partly in section, of a stack of firestarter bricks according to a fifth embodiment of the subject invention; and, FIG. 11 is a perspective view of a firestarter log according to the subject invention.

FIG. 10 shows a stack 82 of bricks 84 according to a fifth embodiment of the subject invention. The bricks 84 have front and rear end walls 86, a left side wall 88, a right side wall 90, a top wall 92 having a first sloped portion 94, a top edge 96, a second sloped portion 98, and flattened end portions 100 adjacent the front end rear end walls 86, and a bottom wall 102 having a first sloped portion 104, a bottom edge 106, a second sloped portion 108 and flattened end portions 110 adjacent the front and rear end walls 86. When the bricks are stacked, the bottom wall flattened end portions 110 and the bottom edge 106 of an upper brick rest on the top wall flattened end portions 100 and the top edge 96 of a lower brick. These bricks contact one another over a generally I-shaped region of contact R5 defined by the top and bottom edges 96 and 106 and the top and bottom flattened end portions 100 and 110. The side walls 88 and 90 are generally oriented vertically when the bricks are stacked and the sloped portions 94, 98, 104 and 108 are angled at about 2 to 10 degrees to the horizontal. Therefore, when the bricks are stacked, small gaps 112 result between the side walls 88 and 90 of adjacent bricks which gaps provide a pry point for separating the bricks. On a typical brick, the resulting gap is on the order of ⅛ inch. This gap in combination with the reduced region of contact between the bricks makes the bricks easy to separate.

The subject invention has been described with respect to several preferred embodiments thereof, it being distinctly understood that many obvious modifications can be made to the invention which still fall within the scope of the claims appended hereto. For example, the invention is applicable to any wax-based brick which is packaged in stacks and needs to be easily separated. The bricks could also be changed to produce a brick having a greater or lesser number of sides than the four to eight shown in the above embodiments without exceeding the scope of this invention. All such modifications are includes within the subject invention to the extent that they are included within the following claims:

I claim:

1. A wax-based fire starter brick having a convex top wall including flattened end portions having a width equal to the width of said brick, a bottom wall, and at least one side wall.

2. The brick of claim 1, wherein said bottom wall is convex.

3. The brick of claim 2, wherein said bottom wall includes flattened end portions.

4. The brick of claim 2, including a front wall and a rear wall wherein said front wall and said rear wall are rectangular.

5. The brick of claim 4, wherein said at least one side wall comprises a first side wall and a second side wall wherein said first and second side walls are rectangular.

6. The brick of claim 1, wherein said convex top wall is comprised of a plurality of planar sections.

7. The brick of claim 2, wherein said convex top wall is comprised of a plurality of planar sections and said convex bottom wall is comprised of a plurality of planar sections.

8. The brick of claim 4 having a cross-section of a first shape through said flattened end portions and a cross-section of a second shape between said flattened end portions.

9. The brick of claim 4, wherein said first shape is a rectangle.

10. The brick of claim 8, wherein said second shape is a polygon having more than four sides.

11. The brick of claim 10, wherein said second shape is an octagon.

12. The brick of claim 10, wherein said second shape is a hexagon.

13. The brick of claim 10, wherein said polygon is convex.

14. A stack of wax-based bricks, each having a front wall, a back wall, a first side wall, a second side wall, a top wall, a bottom wall, a brick length, a brick width and a brick height, said stack including a first stack side wall comprising the first side walls of the bricks in said stack and a second stack side wall comprising the second side walls of the bricks in said stack, and including a channel running in the direction of said brick lengths between the adjacent first side walls of the bricks in said stack, said channel having a channel length shorter than said brick length.

15. The stack of claim 14, wherein said channel is V-shaped.

16. The stack of claim 15, wherein said channel has a depth and said depth is equal to about one third of said brick width.

17. The stack of claim 15, wherein the distance between said adjacent first side walls is approximately ⅛ inch.

18. The stack of claim 17, wherein said V-shaped channel includes first and second channel walls meeting at an angle of less than 20 degrees.

19. The stack of claim 18, wherein said angle is about 10 degrees.

20. A stack of wax-based bricks wherein each of said bricks contacts at least one adjacent brick along an I-shaped region of contact.

21. A wax-based fire starter brick having first and second vertically oriented, parallel, rectangular end walls, first and second rectangular vertically oriented side walls extending between said end walls, a top wall and a bottom wall wherein said top and bottom walls include first and second flat, horizontal end portions extending between said side walls for a distance of about ¼ inch from each of said end walls and a horizontal, centrally disposed strip portion less than about one third of the width of said brick connecting said first and second flat, horizontal end portions to form an I-shaped region of contact and including first and second sloped wall portions for providing a gripping surface when a first one of said brick is stacked on a second one of said brick bounded by said region of contact and each of said side walls, said sloped wall portions being sloped at an angle of less than about 10 degrees from the horizontal such that the cross-section through said horizontal end portions normal to said side walls is generally rectangular and the cross-section through said centrally disposed strip normal to said side walls is octagonal.

22. The brick of claim 21, wherein said angle is about 5 degrees.

23. A fire starter product capable of being stacked into multiple unit stacks comprising multiple similar units, each said unit comprising a wax based brick having a length, a first end, a central portion and a second end; said brick having a uniform cross section in said central portion, said central portion cross section having a bottom, two vertical sides and a top; said top having a flat horizontal center portion, a right side portion sloping downwardly and outwardly and a left side portion sloping downwardly and outwardly.

24. The fire starter of claim 23 wherein said top right side portion and said top left side portion slope downwardly and outwardly at angles of about 5°.

25. The fire starter product of claim 23 wherein said bottom has a flat horizontal center portion, a right side portion sloping upwardly and outwardly and a left side portion sloping upwardly and outwardly.

26. The fire starter product of claim 25 wherein said top right side portion and said top left side portion slope downwardly and outwardly at angles of about 5°; and, said bottom right side portion and said bottom left side portion slope upwardly and outwardly at angles of about 5.

27. A fire starter product capable of being stacked into multiple unit stacks comprising multiple similar units, each said unit comprising a wax based brick having a length, a first end, a central portion and a second end; said brick having a uniform cross section in said central portion said central portion cross section having a bottom, a right side wall, a left side wall and a top; said top having a concave center portion.

28. The fire starter product of claim 27 wherein said top further comprises a right side horizontal portion adjacent said right side wall and a left side horizontal portion adjacent said left side wall.

29. The fire starter product of claim 27 wherein said bottom has a concave center portion, a horizontal right side portion adjacent said right side wall and a horizontal left side portion adjacent said left side wall.

* * * * *